US005343636A

United States Patent [19]

Sabol

[11] Patent Number: 5,343,636

[45] Date of Patent: Sep. 6, 1994

[54] ADDED FOOTWEAR TO INCREASE STRIDE

[76] Inventor: Albert Sabol, 120 Ramblewood Dr., Statesboro, Ga. 30458

[21] Appl. No.: 42,655

[22] Filed: May 24, 1993

[51] Int. Cl.[5] ..... A43B 13/18; A43B 5/06

[52] U.S. Cl. ..... 36/78; 36/27; 482/77

[58] Field of Search ..... 36/27, 7.8, 38, 1; 482/77

[56] References Cited

U.S. PATENT DOCUMENTS

| | | | |
|---|---|---|---|
| 871,864 | 11/1907 | Feazell et al. | 36/7.8 |
| 898,084 | 9/1908 | Backermann | 482/77 |
| 1,205,983 | 11/1916 | Emmerth | 36/7.6 |
| 1,564,307 | 12/1925 | Fereo et al. | 36/7.6 |
| 1,587,749 | 6/1926 | Bierly | 36/7.8 |
| 1,726,028 | 8/1929 | Keller | 36/7.8 |
| 2,172,000 | 9/1939 | Wenker | 36/7.8 |
| 2,305,520 | 12/1942 | Ferrini | 36/7.6 |
| 2,953,861 | 9/1960 | Horten | 36/7.8 |
| 4,267,648 | 5/1981 | Weisz | 36/28 |
| 4,322,893 | 4/1982 | Halvorsen | 36/43 |
| 4,534,124 | 8/1985 | Schnell | 36/7.8 |
| 4,566,206 | 1/1986 | Weber | 36/7.8 |
| 4,592,153 | 6/1986 | Jacinto | 36/7.8 |
| 4,660,299 | 4/1987 | Omilusik | 36/7.8 |
| 4,843,737 | 7/1989 | Vorderer | 36/38 |
| 4,858,338 | 8/1989 | Schmid | 36/44 |
| 4,881,329 | 11/1989 | Crowley | 36/38 |
| 4,936,030 | 6/1990 | Rennex | 36/28 |
| 5,042,175 | 8/1991 | Ronen | 36/28 |

FOREIGN PATENT DOCUMENTS

| | | | |
|---|---|---|---|
| 4849 | of 1899 | United Kingdom | 36/7.8 |

*Primary Examiner*—Steven N. Meyers
*Attorney, Agent, or Firm*—Norman B. Rainer

[57] ABSTRACT

A device to be worn beneath footwear or an unshoed foot for increasing stride and reducing fatigue while providing comfort and stability by absorbing the energy in a stride and by releasing that energy to user. The invention accomplishes this by providing a cantilevered leaf spring joined to but separated from a platform supporting the user. As the user enters a stride weight of the user flexes the spring to store the energy of contact with terrain. Then during the completion of the stride the spring releases that energy to the user.

1 Claim, 2 Drawing Sheets

FIG. 1
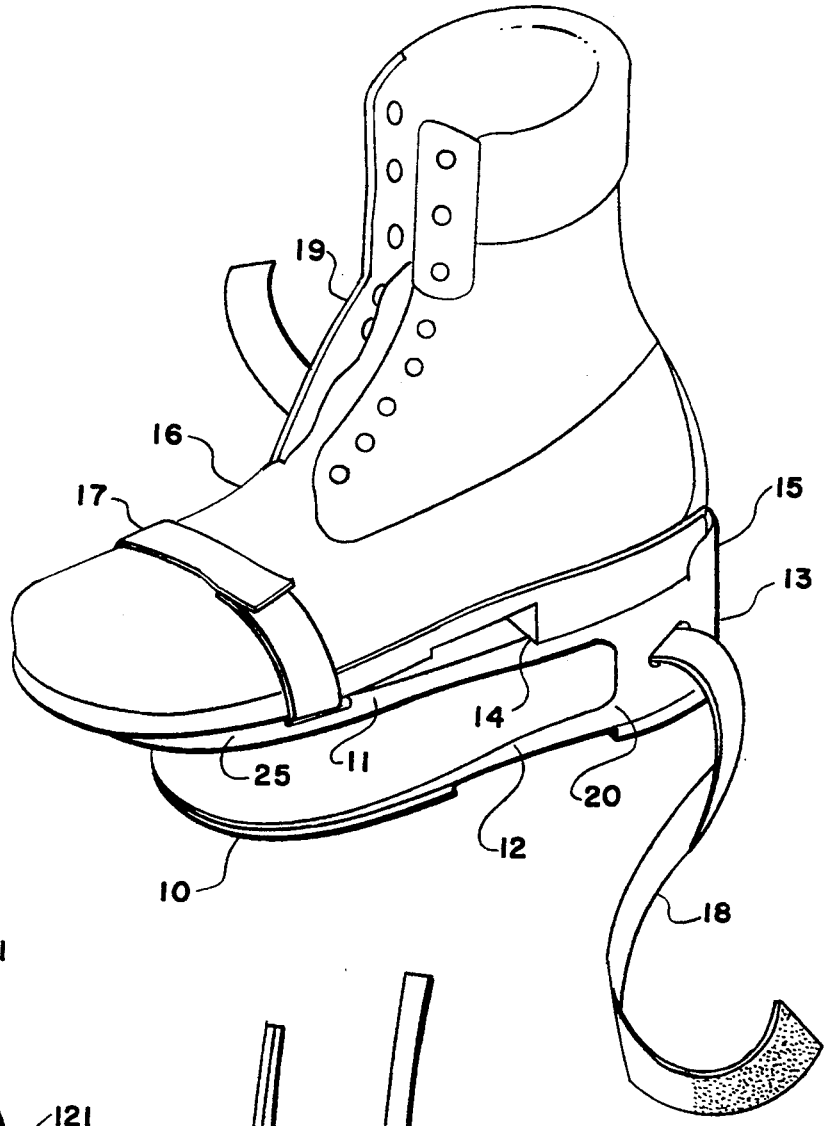
FIG. 2a
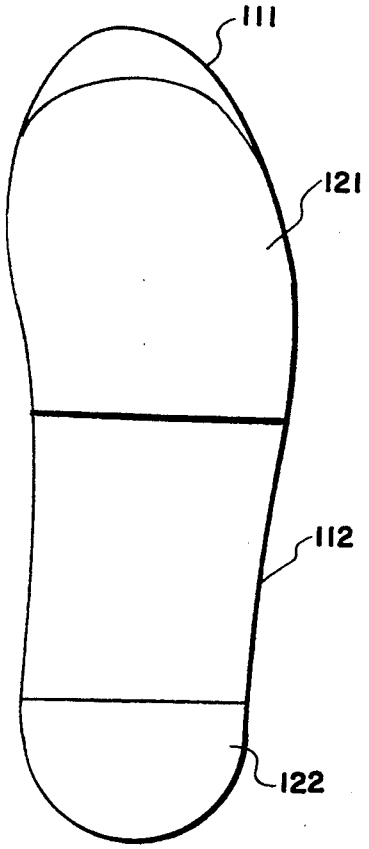
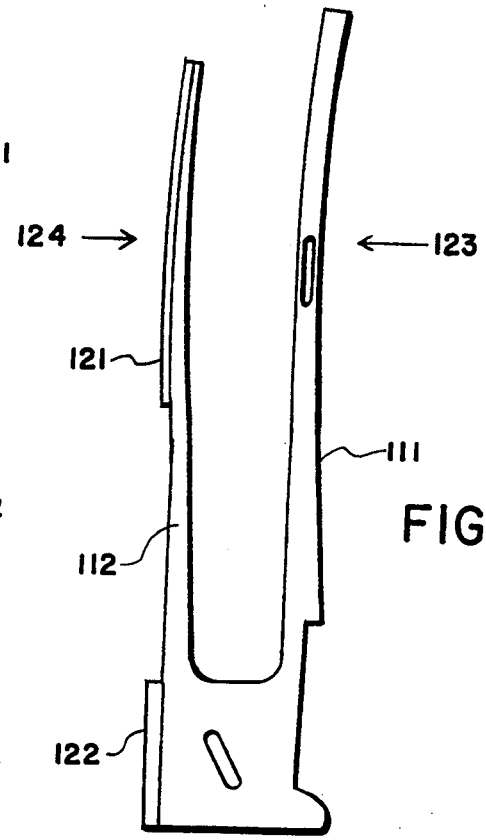
FIG. 2b

FIG. 4
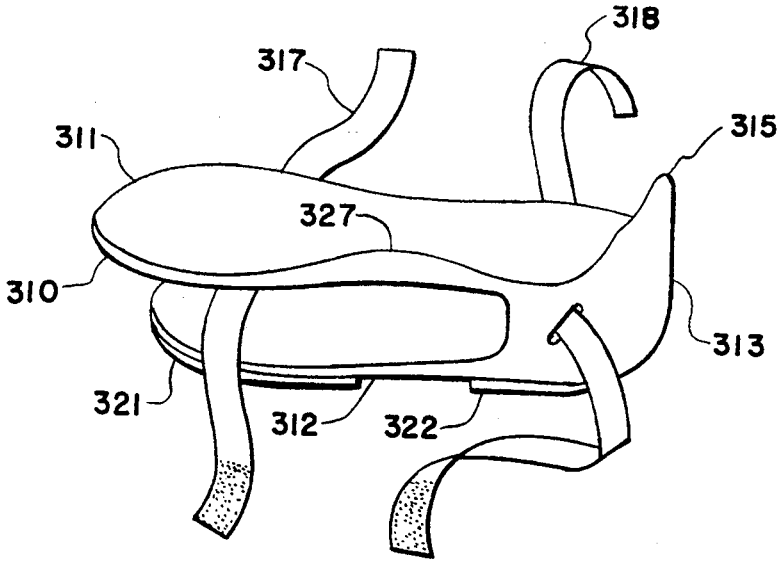
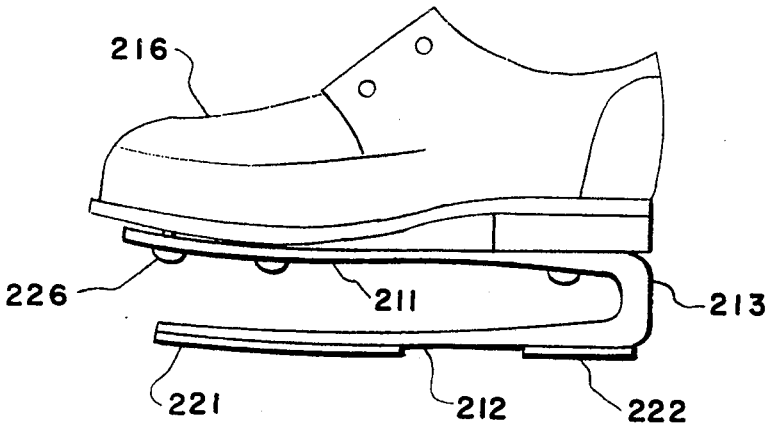
FIG. 3a
FIG. 5
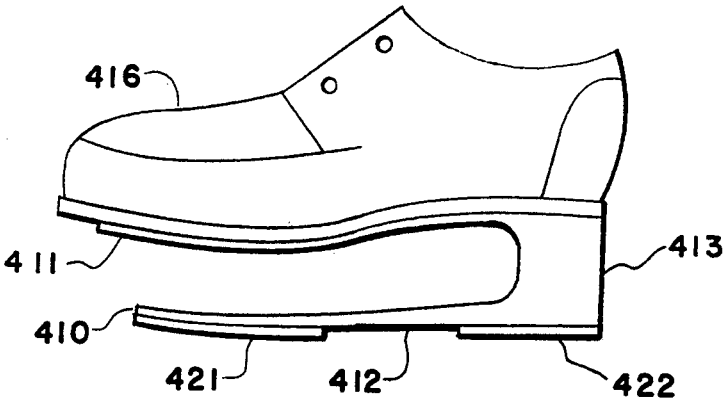

ADDED FOOTWEAR TO INCREASE STRIDE

BACKGROUND OF THE INVENTION

1. Field of the Invention

This invention relates to the improvement in stride resulting from an energy efficient device added to the bottom of a one's foot, by providing increased comfort, by allowing one to attain a stable increased stride, by preventing fatigue, by either permanently or temporarily attaching the device to footwear or temporarily to an unshoed foot, by the bending of a cantilevered leaf spring to store energy during a stride resulting from the application of one's weight and then by the release of that stored energy in the cantilevered leaf spring to assist the user in completing a longer than normal stride.

2. Description of Prior Art

Over the years various efforts have been made to improve one's stride by adding to or incorporating into footwear energy storage and energy releasing devices. The purpose of such devices was to provide a means of increasing the efficiency of one's stride by allowing for an increase in stride or by making the stride more comfortable. Such prior art was directed to absorbing vertically directed energy to then utilizing that absorbed energy in assisting locomotion. However, such footwear devices are either too complicated to economically manufacture, too unstable in use to be sold to the public, too heavey for practical use or too uncomfortable to use for a reasonable length of time. In addition many devices previously proposed must be incorporated into footwear at time of manufacture. Thus, such devices cannot be temporarily used with normally made footwear and none can be used with no footwear at all.

For example, U.S. Pat. No. 4,660,299 to Omilusik is directed to the use of four relatively long coil springs affixed to a platform resting beneath the footwear. Two such springs are located beneath the location of one's heel. While the remaining two coil springs are positioned at a forward location beneath the footwear. In taking a stride the rear most located two springs first make contact with the supporting surface and are compressed by one's weight to absorb some of the energy. As the user moves forward subsequently more energy of the stride is absorbed by the forwardly located coil springs. In completing the stride this absorbed energy is released and can increase one's stride as well as provide comfort for the user. However, since each coil spring affixed to the platform acts independent of its neighboring spring release of the stored energy can be misdirected. Further, since each spring has a small bending moment one's footwear cannot always maintain the properly desired orientation relative to the supporting surface below. Such action would particularly noticeable on ruff terrain. As a result in use the direction of one's travel can be haphazardly altered and the stability of one's vertical stance can be compromised. Thus, use of this device is hazardous to the wearer.

U.S. Pat. No. 4,267,648 to Weisz is directed to an arrangment of relatively short springs disposed within the sole and heel of footwear. The collection of springs separates a bottom movable section of the sole from a load bearing membrane directly beneath and next to the user's foot. Because of the relative short length of the springs during locomotion energy is returned to the wearer only during a very small portion of the stride. Thus, only a small increase in stride can be realized. It is further noted that said invention cannot be used with existing normally manufactured footwaer or without the use of any footwear.

U.S. Pat. No. 5,042,175 to Ronen et. al. discloses a user-specific inner sole spring arrangement to be inserted into a footwear. The invention can also be prefabricated into the sole of footwear. The preferred embodiment of the invention is a coil spring system customized principly to provide comfort to the wearer. The system can also provide increase in stride by absorbing and releasing some of the energy normally expended in locomotion. However, because of limited space in footwear a higher inner sole cannot be used to increase the stide. Further, no claim is made for said Patent to be used with no footwear.

U.S. Pat. No. 4,936,030 to Rennex addresses the problem of comfort to the wearer of footwear as well as to the method of absorbing energy of locomotion and releasing the absorb energy by the use of mechanical devices of levers and hydraulic fluids. It would be uneconomical to manufecture this invention plus as was disclosed in the Patent itself the added weight of the device presents a problem to the wearer. No claim is made to use said device without footwear.

U.S. Pat. No. 4,843,737 is directed to the use of an elliptical spring device disposed within the heel portion of footwear. The purpose of the invention is to provide both comfort to the wearer by absorbing the shock of heel impact with terrain and by the release of that energy to allow the user to expend less energy during activity. Since the major thrust for locomotion comes from forces located at the ball of a foot rather than the heel area this invention does lttle to help increase the stride. Further no claim is addressed to the use of said device without footwear.

U.S. Pat. No. 4,881,329 to Crowley is directed to a spring generally oval-shaped disposed within the midsole area of athletic footwear. Since the major thrust for locomotion comes from forces located at the ball of a foot rather than the midsole region this invention does little to help increase the stride. Further no claim is made to use said device without footwear.

U.S. Pat. No. 4,858,338 to Schmid is directed to the use of an insert of an elastic material disposed within a sole of a shoe to absorb, store and return kinectic energy to the wearer. The invention is not designed to increase comfort to the wearer. Positioning the energy absorbing etc. device directly beneath the sole of the wearer as in the invention can utilize some of the energy stored as the result of impact with terrain and can propel the user to yield an increase in stride. However the action of the flexible insert imbedded within the sole during use applies a force downward on the heel portion of the footwear. Thus, to prevent the heel of the footwear from falling off the foot the force is transmitted to the lacing of the footwear resulting in undue stress on the instep and unecessary chafing of skin at the instep.

SUMMARY OF THE INVENTION

The present invention provides a means for adding comfort and for increasing one's stride during walking, jogging or running by the use of a cantilevered leaf spring device positioned beneath but separated from the sole and heel. The invention is designed to realize a maximum return of the energy expended by the forward portion of the foot and can be used in various ways either parmanently incorporated into footwear or the invention can be temporarilly strapped to to the sole and heel of existing footwear for temporary use. One device is used per each article of footwear. The invention can also be used without footwear.

This invention consists of a platform to support the foot of an user and a cantilevered leaf spring positioned beneath but separated from the supporting platform by a connecting heel section. The cantilevered leaf spring is joined by the connecting heel section approximately parallel to the supporting platform and is designed to support the weight of the user. The cantilevered leaf spring is made from a suitable, relatively light weight flexible, high tensile strength material capable of being flexed such as composite materials of graphite fibers or fiberglass and resin, Adequate space beneath the supporting platform is designed into the device to allow this spring to properly flex upward.

In use as one enters a stride the cantilevered leaf spring stores energy when bent by the weight of the wearer applied by the forward area of the foot. The resisting force of the terrain on the spring is approximately directly beneath the applied force so that no more than normal bending action or couple force is imposed on the footwear. Increased stride is realized when the energy stored in the spring is released during the completion of that stride to propel the user. By incorporating a normally resilient heel each stride transmits a consistent feel of the the terrain to the user and the user experiences a stable balance on contact with the terrain. During each stride bending of the cantilevered leaf spring about only one axis with respect to the user also provides a stable feel absent of any side-to-side rocking sensation allowing the device to be used on rough terrain. Another feature of the invention is the action of the cantilevered leaf spring which during each stride reduces the need for normal bending of the foot to provide for more comfort and less fatigue.

Several embodiments of the invention are disclosed in which the user has the means to apply either permanently or temporarily beneath footwear or beneath an unshoed foot a cantilevered leaf spring communicating through a connecting heel section to a platform to absorb and release the energy of locomotion providing for comfort and for an increase in stride. A first embodiment of the invention is directed to a temporary use with footwear. A cantilevered leaf spring is disposed beneath but in communication with a platform supporting the foot of the user by means of a connecting heel section. The cantilevered spring extends forward approximately parallel to the supporting platform from the connecting heel section and is properly tapered to absorb and release energy of a stride. Design of the connecting heel section provides adequate room for the cantilevered leaf spring to flex upward. Heel and sole pads of a resilient, wear resistant material suitable for contact with the terrain are affixed to the bottom of the cantilevered leaf spring to provide a non-slip footing. Built into the platform is a forwardly located stop and a rear stop to ungulf the heel of footwear to resist any motion relative to the platform. Secured at the conecting heel section and at the forward location of the platform is a means for strapping the platform to footwear. However, other means of attaching this and other embodiments of the invention to footwear are disclosed which will become apparent from further description of the invention.

A second embodiment of this invention relates to a means of attaching the invention to footwear and to a design feature. Attention is directed to a device consisting of a cantilevered leaf spring, a platform and a connecting heel section to separate the cantilevered leaf spring from the platform in order to provide sufficient spring flexing room. All these three sections are fabricated from the same material and are designed with approximately the same but proper thickness. Said cantilevered spring extends forward from the heel area disposed beneath and approximately parallel to the supporting platform. Heel and sole pads of material suitable for contact with terrain and a non-slip footing are affixed to the bottom of the cantilevered leaf spring. A means to attach this embodiment of the invention to commercially available athletic footwear is provided by the use of fasteners connecting the platform to the bottom of footwear.

A third embodiment of the invention is diclosed in which the supporting platform exhibits an upper contoured surface to receive and fit snuggly to an unshoed foot. Raised portions of the upper surface at both the foot arch and heel areas inhibit the relative motion of the foot on the supporting platform. Strapping is provided to secure the device to the foot. A cantilevered leaf spring is joined to the supporting platform through a connecting heel section to allow adequate flexing room for the cantilevered leaf sprimg. Both a heel and a sole pad of suitable resilient contact material are affixed to the bottom of the cantilevered leaf spring to provide a non-slip footing.

A fourth embodiment of the invention is diclosed in which the supporting platform is incorporated as part of the heel and sole member of footwear at time of manufacture. A cantilevered leaf spring is Joined to the built-in platform through a separating, connecting heel section. Heel and sole of pads of a suitable resilient material for contact with terrain are affixed to the bottom of the cantilevered leaf spring.

With the foregoing and other advantages and features of the invention that will become hereinafter apparent, the nature of the invention may be more clearly understood by reference to the following detailed description, the appended claims and to the several views illustrated in the drawings.

BRIEF DESCRIPTION OF THE DRAWING

FIG. 1 is a perspective view of one embodiment of the invention in position beneath commercially available footwear.

FIG. 2*a* is bottom elevation of the cantilevered spring with contact material applied relating to the first embodiment of the invention.

FIG. 2*b* is a left side elevation of the cantilevered leaf spring, supporting platform and the connecting heel separating section relating to the first embodiment of the invention.

FIG. 3*a* is a side elevation of a second embodiment of the invention mounted to footwear.

FIG. 4 is a perspective view of a third embodiment of the inventiion suitable for strapping to an unshoed foot.

FIG. 5 is a perspective view of a fourth embodiment of the invention which is prefabricated into footwear.

DETAILED DESCRIPTION OF THE INVENTION

Referring now in detail to the drawings wherein like parts are designated in FIG. 1. a first embodiment of the cantilevered leaf spring assembly according to the invention which is designated generally by the numeral 10. Assembly 10 comprises a platform 11 joined by connecting heel section 13 to cantilevered leaf spring 12. Both platform 11 and cantilevered leaf spring 12 are not necessarily of the same total length but approximate the outline of normal footwear. For some applications as on rough terrain the extension of the cantilevered leaf spring is abreviated as depicted in FIG. 1. Platform 11 provides for a forward positioned stop 14 as well as for a heel located stop 15 to engulf the heel of footwear 16 in order to restrict the relative motion of footwear 16 on platform 11. A means is provided for securing footwear 16 snuggly to platform 11 by use of strap 17 joined to platform 11 at position 25 and by strap 18 attached to connecting heel section 13 to wrap around area of instep 19. Securing straps 17 and 18 by such means as the use of Velcro prevents footwear 16 separating from platform 11. Connecting heel section 13 is designed to allow adequate space beneath platform 11 for proper flexing upward of cantilevered leaf spring 12.

As shown in FIG. 2*a*, a bottom elevation of the first embodiment of the invention, sole 121 and heel 122 of a resilient, wear resistant, material suitable for contact with terrain are affixed to the bottom of cantilevered leaf spring 112 to prvide a non-slip footing.

FIG. 2*b* is a left side elevation of the first embodiment of the invention. Cantilevered leaf spring 112 is fabricated from suitable high tensile strength flexible material such as composite material of graphite fibers or fiberglass and resin and flexes from point 20, FIG. 1. Thickness of cantilevered leaf spring 112 properly tapers from point 20 forward allowing said spring to bend under load with an uniform radius of curvature. Cantilevered leaf spring 112 is of proper design and construction to provide for adequate deflection. Platform 111 and connecting heel section 13, FIG. 1, are fabricated from appropriate materials and are integrated with cantilevered leaf spring 112 during manufacture.

FIG. 3 is a left elevation of the second embodiment of the invention secured with fastnets 226 passing through openings in platform 211 aligned to threaded holes in commercially available athletic footwear 216. Platform 211, connecting heel section 213 and part of cantlevered leaf spring 212 are approximately the same but proper thickness and are manufactured of the same material. Connecting heel section 213 is designed to allow cantilevered spring 212 to adequately flex upward beneath platform 211. Pads 221 and 222 of suitable wear resistant, resilient material for contact with terrain are applied to the bottom of cantilevered spring 212. Other means illustrated in this disclosure can also be employed to secure this embodiment of the invention to footwear.

FIG. 4 is a perspctive view of the third embodiment of the invention 310 adapted for use with no footwear. Platform 311 is joined to and communicates through heel connecting section 313 to cantilevered leaf spring 312. Platform 311 is contoured at the arch of the foot 327 and at the foot heel area 315 to restrict the motion of the foot on platform 311. Invention 310 is held snuggly to the foot by use of straps 317 and 318 secured by such means as Velcro. In use cantilevered spring 312 is allowed to fully flex in the space provided by the design of heel connecting section 313. Pads 321 and 322 of suitable wear resistant, resilient material for contact with terrain are applied to the bottom of cantilevered leaf spring 312.

FIG. 5 is a left elevation of the fourth embodiment of the invention 410 which is permanently incorporated into footwear 416 or, as shown in FIG. 5, permanently attached to footwwear 416 during fabrication. Platform 411 is secured to cantilevered spring 412 through connecting heel section 413. Connecting heel section 413 is designed as to allow adequate room for flexing of the cantilevered leaf spring upward beneath platform 411. Pads 421 and 422 are as earlier described to provide a non-slip footing.

Use of the invention is described with reference to the first embodiment, but is the same for each of the other embodiments, as follows: The user places footwear 16 on platform 11 and the invention 10 is attached to the bottom of footwear 16 by means of straps 17 and 18. Straps 17 and 18 are secured by such means as Velcro. Strap 17 secures the forward portion of footwear 16 while strap 18 secures the heel portion of footewear 16. A forward positioned stop 14 and a heel stop 15 prefabricated into platform 11 prevent the relative motion of footwear 16 on platform 11.

In use on entering a stride the user's weight is applied to platform 11 in the area of the ball of the foot as depicted by arrow 23. An equal but opposite directed force at arrow 24 approximately directly beneath the applied force at arrow 23 is exerted by the terrain to bend the cantilevered leaf spring 12 upward with an uniform radius of curvature. As the foot rolls forward during the continuation of the stride arrows 23 and 24, where forces are applied, move forward together maintaining their approximate relative opposite positions. Thus, no downward force or moment is relayed to connectin heel section 13 to exert a pulling load at the heel of footwear 16 or to create any unnatural feel on the foot of the user.

During application of the user's weight at arrow 23 energy is stored in the resulting flexed cantilevered leaf spring 12. As the user then progresses into the completion of the stride this stored energy is returned to propel the user into a longer stride. The amount of energy stored in the cantilevered leaf spring and degree of spring deflection is determined by design. In addition the return of this stored energy allows for less foot movement which reduces fatigue and allows for a more comfortable feeling stride.

Since the cantilevered leaf spring 12 flexes about only one axis with respect to the user, this stops any rocking or any side-to-side motion being transmitted to footwear 16 and no spurious forces can be exerted by invention 10 on the foot which allows the user to experience a normally stable feel over any type of terrain. At the instant of completing a stride on contact with terrain heel pad 22 also provides a normally stable feel over terrain. All these described actions are consistant with all other embodiments of the invention.

Although certain presently preferred embodiments of the invention have been described herein, it will be apparent to those skilled in the art to which the invention pertains that variations and modifications of the described embodiment made be made without departing from the spirit and the scope of the invention. Accordingly, it is intended that the invention be limited only to the extent required by the appended claims and the applicable rules of law.

What is claimed is:

1. An energy efficient footwear device comprising:

a) a horizontally disposed platform upon which the user's foot rests, said platform having front and rear extremities and upper and lower surfaces, said upper surface having forwardly and rearwardly disposed stops to prevent movement of said foot upon said upper surface, b) a heel section downwardly emergent from the lower surface and rear extremity of said platform as a continuous integral extension thereof, c) leaf spring means disposed in part as a flat panel portion beneath said platform and parallel thereto, and extending rearwardly through said heel section and upwardly into said platform as an integral spring structure of cantilevered shape, said flat panel portion extending to a forward extremity located rearwardly of the front extremity of said platform, said panel portion having top and bottom surfaces, the thickness of said panel portion, measured between said top and bottom surfaces diminishing in tapered fashion in going from said heel section to said forward extremity, the spacing between the lower surface of said platform and top surface of said panel portion being about one sixth the length of said panel portion, d) heel and sole pads of wear resistant resilient material joined to the bottom surface of said panel portion, and e) means interactive with said platform to secure said device to the user's foot, whereby f) said panel portion during use bends in a uniform radius of curvature and imparts forward thrust to the user's stride.

* * * * *